US005081465A

United States Patent [19]

Collignon

[11] Patent Number: 5,081,465

[45] Date of Patent: Jan. 14, 1992

[54] SPATIALLY SELECTIVE DEVICE FOR THE ABSORPTION OF ELECTROMAGNETIC WAVES, FOR A MICROWAVE LENS

[75] Inventor: Gérard Collignon, Limours, France

[73] Assignee: Thomson-CSF Radant, Les Ulis, France

[21] Appl. No.: 621,880

[22] Filed: Dec. 4, 1990

[30] Foreign Application Priority Data

Dec. 5, 1989 [FR] France ..... 89 16031

[51] Int. Cl.[5] ..... H01Q 15/040; H01Q 19/060

[52] U.S. Cl. ..... 343/754; 343/753

[58] Field of Search ..... 343/753, 754, 909, 910, 343/911 R, 841; 342/372

[56] References Cited

U.S. PATENT DOCUMENTS

| | | | |
|---|---|---|---|
| 4,320,404 | 3/1982 | Chekroun | 343/754 |
| 4,447,815 | 5/1984 | Chekroun et al. | 343/754 |
| 4,480,258 | 10/1984 | Wren | 343/909 |
| 4,975,712 | 12/1990 | Chen | 343/753 |

FOREIGN PATENT DOCUMENTS 2512280 8/1981 France .

OTHER PUBLICATIONS

Electronics and Communications in Japan, vol. 60-B, No. 7, Jul. 1977; Takashima et al., "A Design Method of Electromagnetic Absorbing Walls with Resistive Sheets".

*Primary Examiner*—Rolf Hille
*Assistant Examiner*—Peter Toby Brown
*Attorney, Agent, or Firm*—Pollock, VandeSande & Priddy

[57] ABSTRACT

Disclosed is a device designed to selectively absorb the electromagnetic waves coming from multiple reflections in a microwave lens. In an antenna of the type including an energy source and a lens, where the lens is formed by a plurality of parallel channels separated by conductive planes, the device has a slot made in each of the conductive planes, arranged on the input face side of the lens, and also has localized or distributed resistors connecting the two edges of the slot. The geometry of the entire unit, and the values of the resistors are such that the waves coming from multiple reflections are absorbed by the resistors.

6 Claims, 3 Drawing Sheets

FIG. 5
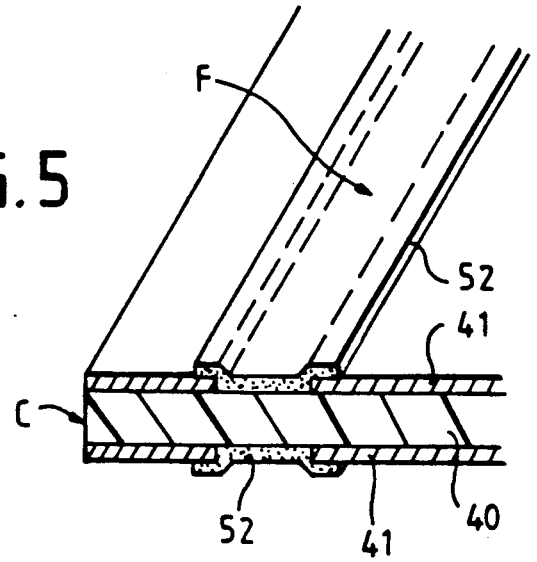
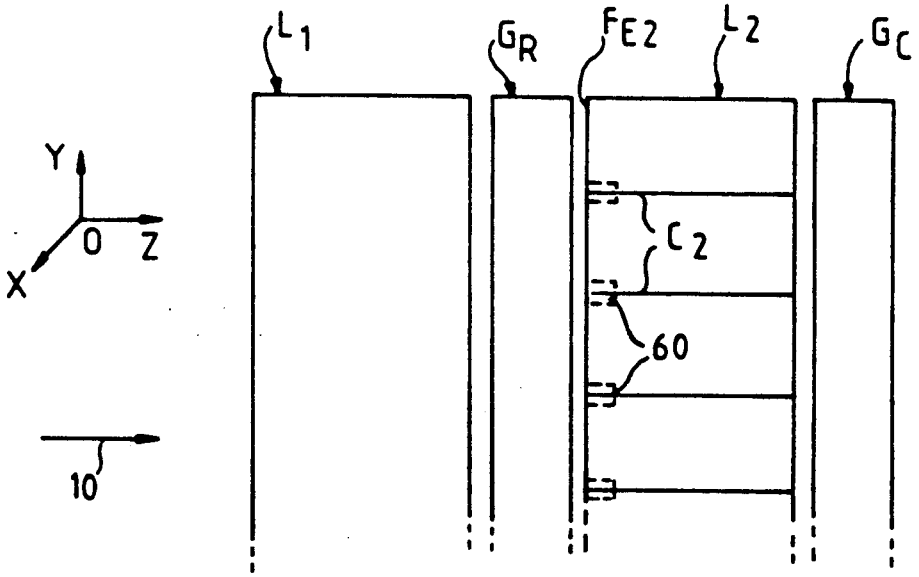
FIG. 6

SPATIALLY SELECTIVE DEVICE FOR THE ABSORPTION OF ELECTROMAGNETIC WAVES, FOR A MICROWAVE LENS

BACKGROUND OF THE INVENTION

1. Field of the Invention

An object of the present invention is a device designed to be used in a microwave lens. It is designed, more particularly, to absorb the stray reflections that occur under high incidence.

2. Description of the Prior Art

An antenna, for example of the type described in the French patent No. 2.469.808, uses a microwave lens positioned in front of a source that gives it an electromagnetic wave. The lens described in the above patent is formed by a stack of phase-shifters separated by conductive planes, each phase-shifter being itself constituted by a stack of panels positioned along the direction of propagation of the wave. The wave emerging from the lens forms an angle $\theta$ with its initial direction. This angle $\theta$, called an angle of incidence, depends on the controls applied to the different phase-shifters.

When the angle of incidence is great, parasitic reflections of the microwave appear at the output face of the lens. This reflected wave, after going through the phase-shifters, returns towards the input face of of the lens, and at least a part of this energy gets reflected again. It again crosses the phase-shifters towards the output face where, at least in part, it comes out of the lens to form a parasitic radiation with an angle of incidence that is no longer the initial angle but is greater than it. Besides, that part of the energy which has not come out is again reflected, as described above, and gives rise to a new emerging parasitic beam, at an even greater angle of incidence, etc. When the radiation pattern of an antenna such as this is measured, secondary lobes due to the numerous reflections are thus seen to appear. This phenomenon grows in intensity with the value of the angle of incidence.

SUMMARY OF THE INVENTION

An object of the present invention is a device designed to absorb these multiple reflections at the input face of the lens, said device being spatially selective in order to absorb only the multiple reflections and not disturb the useful wave.

More precisely, the invention consists in the positioning of slots in the conductive planes between the phase-shifters, near the input face of the lens and parallel to it, before the phase-shifters: the useful waves received from the source then show no phase shift, at these slots, and the only ones that show a phase shift are the waves arising out of the multiple reflections. Each slot has resistors, the geometry of the entire unit and the values of the resistors being such that:

when the waves getting propagated in two adjacent phase-shifters show no relative phase-shift, the device according the invention is ineffective;

when the waves getting propagated in two adjacent phase-shifters have a relative phase-shift, which is expressed by the existence of currents in the conductive planes, these currents and, consequently, the waves are absorbed by the resistors.

BRIEF DESCRIPTION OF THE DRAWINGS

Other objects, special features and results of the invention will emerge from the following description, given by way of a non-restrictive example and illustrated by the appended figures, of which:

FIG. 5 shows a third embodiment of the invention;

FIG. 6 exemplifies an application of the device according to the invention.

In this invention, the same reference numerals are repeated for the same elements.

Moreover, in all the explanations given herein it is assumed, for simplicity's sake, that the antenna is working in transmission, it being understood that operation in reception mode is symmetrical.

DETAILED DESCRIPTION OF THE INVENTION

Figure 1:
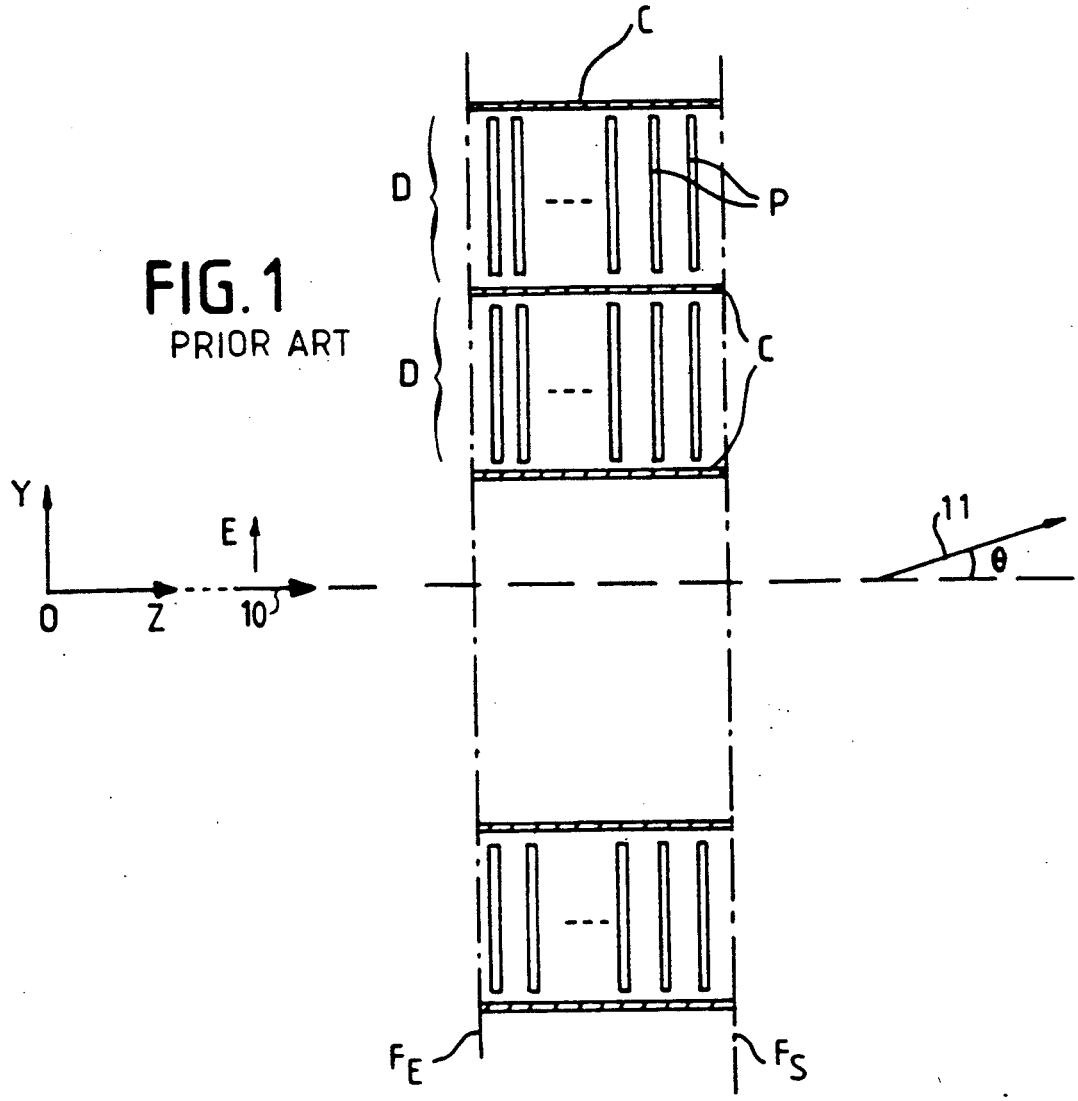
FIG. 1 PRIOR ART
FIG. 1 shows a drawing of a microwave lens according to the above-mentioned patent.

FIG. 1 therefore gives a schematic view of the microwave lens described in the above-mentioned patent.

This lens receives an incident energy illustrated by an arrow 10, being propagated in a direction OZ, the electrical field of this energy being directed along an axis OY which is normal to the preceding direction. The lens is formed by a plurality of phase-shifters D, stacked along the axis OY and separated by conductive planes C, which extend substantially perpendicularly to the axis OY. The space included between two planes C is hereinafter called a phase-shifter or a channel without discrimination between these two terms. Each of the phase-shifters communicates a phase shift to the microwave that goes through it, the value of this phase shift being electrically controllable. The wave emerging from the lens, illustrated by an arrow 11, thus makes an angle $\theta$ in the plane YOZ with its initial direction, this angle $\theta$ being called an angle of incidence. As is well known, the value of the angle $\theta$ is a function of the value of the phase-shifts introduced by each of the phase-shifters. FIG. 1 also shows, by means of dashes, the input face $F_E$ of the lens, located on the incident energy side 10, and the output face $F_S$, located on the emergent wave side 11.

Each of the phase-shifters D is formed by a set of panels P, positioned in parallel to one another and perpendicularly to the direction OZ of propagation of the energy.

Figure 2:
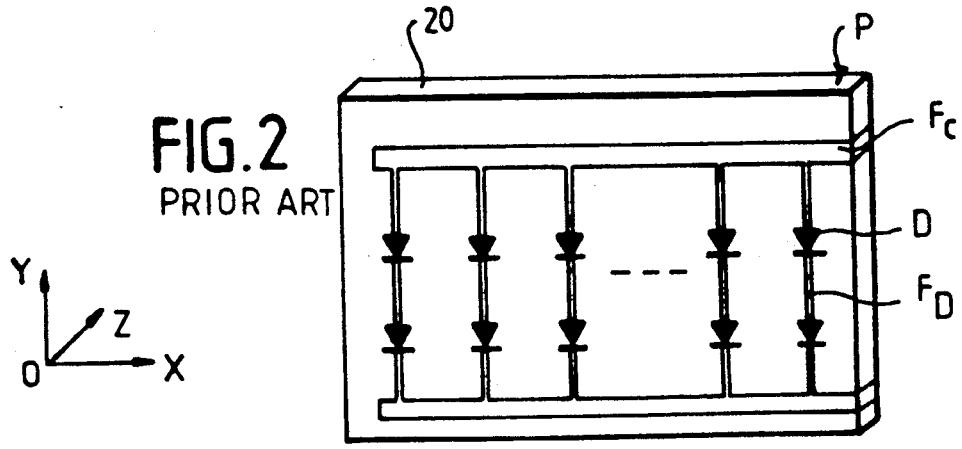
FIG. 2 PRIOR ART
FIG. 2 shows a drawing of a phase-shifter panel used in the device of the foregoing figure.

FIG. 2 is a drawing of an embodiment of a phase-shifter panel P used in the lens of FIG. 1.

This panel P includes an insulator substrate 20 extending in a plane XOY perpendicular to the direction OZ. Wires $F_D$ are positioned on the substrate 20. Each of these wires $F_D$ has a certain number of diodes D, for example, two in the figure. The diode-fitted wires $F_D$ are positioned parallel to the direction of the electrical field of the incident wave, that is, to the axis OY. The bias voltage of the diodes D is conveyed to the diodes of the panel P by two control wires $F_C$ connecting all the diode-fitted wires $F_D$ and positioned parallel to the axis OX. The wires $F_C$ and $F_D$ are preferably made in the form of conductors printed on the substrate 20.

Controlling the state (on or off) of the set of diodes D of a panel makes it possible to vary the phase-shift undergone by the wave going through this panel.

It is thus seen that, by positioning a plurality of panels P along the axis OZ and controlling them independently of one another, a phase-shifter D is set up with a number of distinct values of possible phase shifts that depends on the number of panels.

Figure 3:
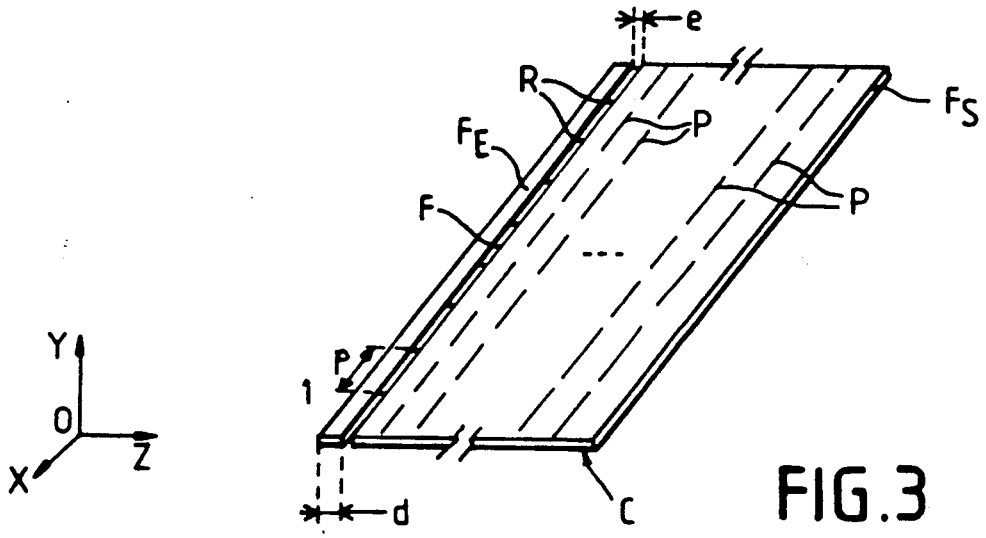
FIG. 3 shows a first embodiment of the invention.

FIG. 3 shows a first embodiment of the device according to the invention.

This figure shows a conductive plane C extending along the plane XOZ constituted, for example, by a metal plate. Dashes have been used to illustrate the outlines, parallel to the axis OX, of the phase-shifter panels P.

According to the invention, an electrical discontinuity F is made in each of the conductive planes C, in the form of a slot extending along the axis OX between the input face $F_E$ of the lens, at a distance (d) from it, and the first of the phase-shifter panels P. Slot F has a width (e) Resistors R are electrically connected between the two edges of the slot F. They are laid out at a pitch (P).

This device works as follows.

When the waves that go through the channels located on either side of the conductive plane C are in phase, the conductive planes C play no role. Indeed, the waves that get propagated in the channels adjacent to a given conductive plane C induce currents in this plane. When the waves are in phase, these currents cancel each other out mutually. Consequently, the slot and its resistors will have no effect on the energy being propagated in the channels. This situation is that of the incident energy (arrow 10 in FIG. 1) which is thus not disturbed by the presence of the device according to the invention.

When, on the contrary, the waves present in the adjacent channels are parasitic waves coming from multiple reflections as explained further above, they have gone through the phase-shifter channels at least twice, and then show a relative phase shift between one channel and another. The currents created by these waves in the conductive planes no longer cancel each other out, up to the point where they get added to each other when the phase shift reaches 180°. According to the invention, these currents are then absorbed by the resistors R, the geometry of the whole device namely the distance (d) from the slot F to the input face $F_E$, the pitch (p) of the resistors, and the width (e) of the slot, notably, as well as the value of the resistors being optimized so that the absorption is the maximum for the usual phase-shift values of the parasitic waves. The values of the different parameters may be obtained by computation and/or experimentally. The computation is done by assuming a case where the waves propagated in two adjacent channels are in phase opposition and by writing the equations of the equivalent circuit of the device in a standard way and adding thereto the fact that there are no reflections, i.e. that the circuit is matched and that its impedance is equal to that of the wave.

For example, a device according to the invention was prepared with the following values: a distance (d) of the order of a quarter of the wavelength of the wave going through the lens, or a multiple of it; a pitch (p) smaller than a half wavelength and a thickness (e) of the order of one-tenth of the wavelength.

Figure 4:
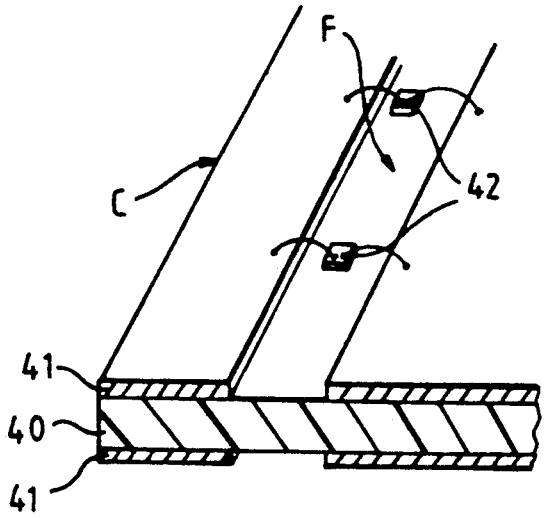
FIG. 4 shows a second embodiment of the invention.

FIG. 4 gives a schematic view of a second embodiment of the invention.

This figure shows a fragment of a conductive plane C. It is made by a conductive layer 41 deposited on both faces of an insulator substrate 40, for example of the type used to make printed circuit boards. The electrical discontinuity F, or slot, in the conductive plane is formed herein by an absence of conductive layer, on the two faces of the substrate 40.

The resistors R of FIG. 3 are, in this embodiment, made by means of discrete components 42, deposited on both faces of the insulator substrate 40 and connected on either side to the metal deposits 41, as illustrated for the upper face on the figure.

It is clear that the determining of the parameters of the absorption device according to the invention takes account of the fact that the device includes, herein, two series of resistors and no longer only one series as in the case of FIG. 3. At a rough estimate, this may mean that, in the equivalent circuit, there are two resistors present in parallel instead of only one.

FIG. 5 shows a third embodiment of the device according to the invention.

Like the previous figure, this figure shows the conductive plane C formed by means of an insulator substrate 40 on which there are deposited two conductive layers 41, except on the zone intended to form the electrical discontinuity, or slot, F.

This embodiment differs from the previous one in that the resistors R of FIG. 3 are made herein by a continuous deposit, on each of the faces of the plane C, of an electrically resistive material 52 on the substrate 40, at the slot F and going over on either side of the conductive layer 41. This material 52 may be, for example, a screen-printed ink such as those used for making resistors in the technique of hybrid circuits.

FIG. 6 gives a schematic view of an exemplary application of the device according to the invention.

In this figure, $L_2$ designates a microwave lens as described with reference to FIGS. 1 and 2 above. The figure also schematizes its conductive planes, herein referenced $C_2$, positioned in parallel to the plane XOZ and demarcating the channels of the lens. Finally, a rectangle 60, in dashes, illustrates the slot and the resistors made in each of the conductive planes $C_2$ on the input face $F_{E2}$ side of the lens $L_2$. It must be noted that the conductive planes C, positioned at the ends of the stack forming the lens, do not require any absorbent device 60.

In this example of an application, the lens $L_2$ does not receive the energy coming directly from a microwave source but an energy that has already undergone a deflection in the plane XOZ by means of a first lens $L_1$ that is similar to the lens $L_2$ but has its conductive planes extending along the plane YOZ. The lens $L_1$ is advantageously also provided with an absorption device according to the invention (notshown). The two lenses are separated by a polarization rotation grid $G_R$ designed to make the polarization of the wave emerging from the lens $L_1$ rotate by 90°, so that it is perpendicular to the conductive planes $C_2$. In this example, the lens $L_2$ is furthermore followed by a polarization switching grid $G_C$ which either transmits the wave that it receives without modification of its polarization or else makes the polarization of the wave undergo a rotation.

In one alternative embodiment, the lens $L_1$ further has integrated means for the generation of a microwave in each channel. In this case, the absorption device according to the invention is positioned between the generation means and the phase-shifter panels.

We have thus described a device enabling the absorption of microwaves in the resistors R, this being done in a selective manner, called a spatially selective manner, because only the waves forming rays with a wide angle of incidence are absorbed.

What is claimed is:

1. A device for absorption of electromagnetic waves in a microwave lens, the lens including a stack of phase-shifters along a first direction, the phase-shifters being separated by conductive planes arranged substantially perpendicularly to the first direction, each phase-shifter including a stack of phase-shifter panels along a second direction substantially normal to the first direction, said device comprising an electrical discontinuity made in each of said conductive planes positioned between two phase-shifters, said discontinuity having two edges and being positioned along a third direction that is substantially normal to the first and second directions, between a first face of the lens receiving the electromagnetic wave and the first of the phase-shifter panels, said device further comprising electrically resistive means connecting the two edges of said discontinuity.

2. A device according to claim 1, wherein each of said conductive planes is formed by a metal plate, said discontinuity being formed by a slot in said metal plate.

3. A device according to claim 1, wherein each of said conductive planes comprises an insulator substrate and two conductive layers respectively deposited on each of the faces of said substrate, except at the location of the discontinuity.

4. A device according to claim 1, wherein said resistive means comprise discrete resistors connected between the two edges of said discontinuity.

5. A device according to claim 3, wherein said resistive means comprises two resistive layers respectively deposited on each of the faces of said insulator substrate at the location of the discontinuity and in contact with the conductive layer.

6. A microwave antenna, comprising a microwave source illuminating said lens, said lens being provided with the device according to any one of the preceding claims.

* * * * *